US007087828B2

(12) United States Patent
Krieger

(10) Patent No.: US 7,087,828 B2
(45) Date of Patent: Aug. 8, 2006

(54) INSTRUMENT AND METHOD FOR GENERATING SOUNDS

(76) Inventor: Rolf Krieger, Dorf 18, CH-9053 Teufen (CH)

( * ) Notice: Subject to any disclaimer, the term of this patent is extended or adjusted under 35 U.S.C. 154(b) by 291 days.

(21) Appl. No.: 10/276,676

(22) PCT Filed: May 23, 2001

(86) PCT No.: PCT/CH01/00323

§ 371 (c)(1),
(2), (4) Date: Nov. 15, 2002

(87) PCT Pub. No.: WO01/91103

PCT Pub. Date: Nov. 29, 2001

(65) Prior Publication Data

US 2003/0136248 A1 Jul. 24, 2003

(30) Foreign Application Priority Data

May 23, 2000 (CH) ..... 1029/00

(51) Int. Cl.
*G10G 7/02* (2006.01)

(52) U.S. Cl. ..... 84/454; 84/723; 84/735; 84/737

(58) Field of Classification Search ..... 84/600, 84/645, 723, 725–727, 730–731, 735, 737, 84/454–455, DIG. 18
See application file for complete search history.

(56) References Cited

U.S. PATENT DOCUMENTS 2,030,230 A 2/1936 Severy
4,024,787 A * 5/1977 Larson ..... 84/743
5,070,759 A 12/1991 Hoover et al.
5,142,961 A 9/1992 Paroutaud
5,315,060 A 5/1994 Paroutaud

FOREIGN PATENT DOCUMENTS

| | | |
|---|---|---|
| DE | 927550 | 2/1956 |
| DE | 31083 | 7/1984 |
| EP | 0539232 | 4/1993 |
| FR | 2315740 | 1/1977 |
| GB | 1343766 | 1/1974 |
| WO | 9828732 | 7/1998 |

* cited by examiner

*Primary Examiner*—Marlon Fletcher
(74) *Attorney, Agent, or Firm*—Harness, Dickey & Pierce, PLC

(57) ABSTRACT

An innovative music instrument (101) comprises at least one tunable string (102), a holding device (106) for holding the at least one string (102), an electrically or electronically operated exciting device (116,116') for contactlessly exciting of the at least one string (102), a sounding body (108) for acoustically radiating oscillations of the string and an interface (113) for supplying a signal to the exciting device (116, 116'), wherein the signal is produced independently from the at least one string (102). The exciting device (116, 116') enables exciting oscillations of the string of a sufficiently large amplitude so that the sounding body (108) can radiate tones of a loudness which is at least in the range of known acoustical string instruments. For transferring the string's oscillations to the sounding body (108), a bridge (112) is arranged between the sounding body (108) and the at least one string (102) . The electro-acoustical music instrument (101) has the quality of resonance capability and of discrete overtones, and enables a synthesis of an acoustical sounding beauty with electronic flexibility.

21 Claims, 9 Drawing Sheets

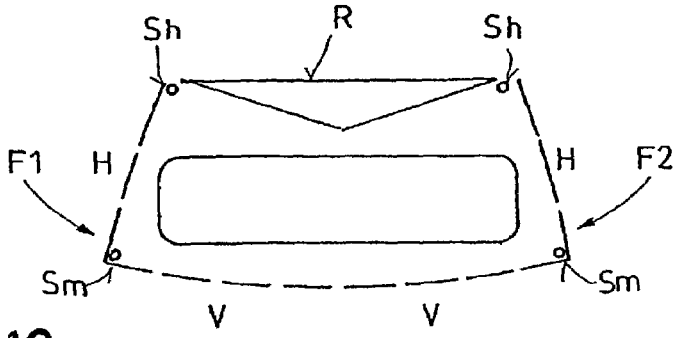
Fig.16a
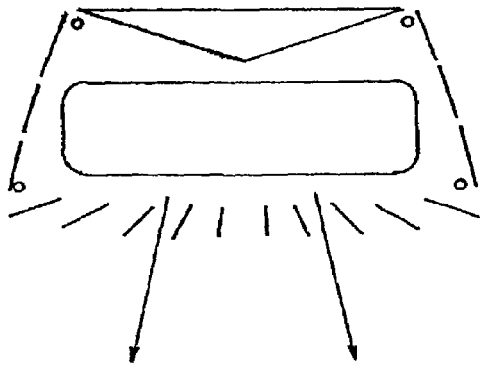
Fig.16b
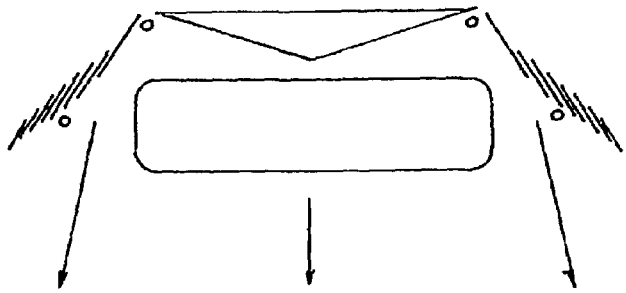
Fig.16c
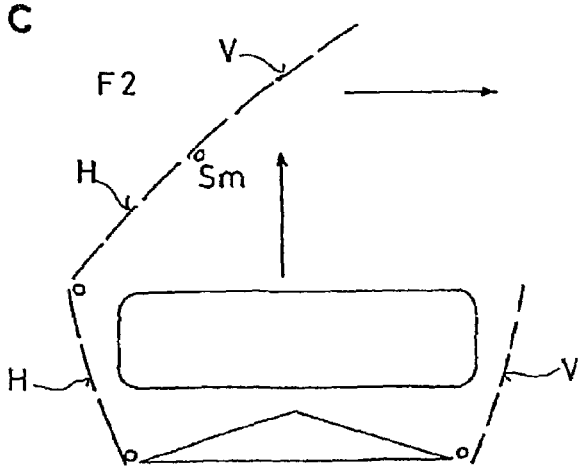
Fig.16d F1

INSTRUMENT AND METHOD FOR GENERATING SOUNDS

FIELD AND BACKGROUND OF THE INVENTION

The present invention relates to a music instrument, an excitation device for contact-less excitation of at least one prestressed string by a magnetizable material, as well as to a method for generating sounds.

Known music instruments can, in principle, be classified into two groups, i.e. in acoustical ones and in electric ones, particularly electronic instruments. Acoustical instruments radiate the sound or tone with sufficient loudness so that a piece performed by an acoustical instrument can be directly heard by the audience. For generating and radiating sound acoustical string instruments comprise strings, a tensioning device for the strings and a resonance body, wherein the strings are mechanically started oscillating, the string oscillations are transferred to the resonance body and are radiated by the latter. The various string instruments have each characteristic sounding properties which depend on the strings, the tensioning device, the resonance body and of the mechanical excitation. Electric or electronic instruments generate an electric or electronic signal which is supplied to a loudspeaker via an amplifier and is radiated by the loudspeaker. For playing an electric instrument, a bank of keys or keyboard is provided. The keys may release a signal either directly and/or they may excite a physical system, of which at least one parameter is tapped and transformed into an electric signal. Such a physical system may be used for detecting a characteristic of stroke. With synthesizers, there exist diverse possibilities of a signal alteration. In the case of electroguitars and electrobasses, the physical string oscillation is mechanically excited and is picked up by a cartridge (pick-up) and is fed to a loudspeaker via an electric or electronic circuit. For generating electronic sound signals, MIDI-appliances, such as a MIDI-sax, may be used. A MIDI-sax detects, apart from the grip, also the throughput of air and, optionally, a force which acts from the lips onto the mouth piece, particularly onto a reed. The parameters detected enable generating a signal which, apart from tone pitch and the duration of a tone, comprises also the dynamics of loudness and, optionally, further tone properties. The sound quality of an electric instrument will always depend on the circuitry used and the loudspeaker coupled to it.

From document FR 2 313 740, an apparatus is known in which a plurality of prestressed strings of equal length are each excited in a contact-less manner by an electromagnetic exciting element. In order to be able to start the strings oscillating by changing magnetic fields, the strings are formed of a magnetic material. The strings are arranged between two disks, the disks being kept in a predetermined distance to each other by a cylindrical base. Each exciting element is fed by a frequency so that each string is excited and vibrates at its basic frequency corresponding to its respective string tension. For feeding the exciting elements, a multivibrator having an adjustable frequency is used. In order to render the oscillation of a string audible, it is picked up by a pick-up, and the signal, thus obtained, is supplied to a loudspeaker via an amplifier. The sound generated by such an apparatus will result from the superposition of the basic oscillations of the strings. Thus, it is only a sound source rather than an instrument that can be played. In addition, the sound quality is limited by the loudspeaker.

WO 98/28732 discloses an electroguitar, that can be automatically tuned, in which the strings to be tuned are electromagnetically excited whereupon the string tension is adjusted by an automatic tensioning device. Exciting of each string is effected with the frequency of the desired basic oscillation, and the actually resulting string oscillation is picked up by a pick-up so that a signal of adjustment can be determined from the difference between the desired and picked-up frequencies. The amplitudes necessary for tuning are very small. The electromagnetic excitement device starts the strings oscillating at hardly audible oscillations by a simple electromagnet.

EP-A-0 539 232 discloses an approach for a prolonged oscillation period of a mechanically excited string of an electric string instrument. To this end, the frequency of the excited oscillation is picked by a pick-up device. The signal of the pick-up device is amplified and fed to an electromagnetic exciting device, which keeps the string further oscillating. U.S. Pat. No. 5,070,759 discloses also an approach for a prolonged oscillation period of a mechanically excited string. It is suggested to use the exciting device also as the pick-up. In both approaches, the signal used for exciting is originated from the string itself, and for generating an audible sound, the signal picked up is fed to a loudspeaker via an amplifier. The exciting devices described comprise each at least one coil and parts of magnetizable material and/or parts of a magnetic material. Each coil extends over the whole region which comprises the strings. In order to be able to excite the strings sufficiently, coils of thicker wires and elevated numbers of windings are used, as compared with a pick-up. In addition, examples are described in which the density of the magnetic field is different for differently thick and differently strongly prestressed strings. To this end, either the magnetizable material within the coil is subdivided into different regions associated to the respective strings by slots or different permanent magnets are assigned to the strings. In these known exciting devices, the electromagnetic field used for exciting extends always over the whole region containing all strings. If a signal stems only from one string, merely a small area of the exciting field is used for exciting this string. The efficiency of this exciting device is very small, and only faint excitements can be achieved which are than acoustically radiated through an amplifier and a loudspeaker.

The acoustical as well as the electric music instruments have their respective limitations. In the case of the acoustical instruments, generating sounds is limited to an appropriate operation of the instrument by a playing person. In the case of electric instruments, a limitation is given by using the necessary loudspeaker. By the known exciting devices for exciting an oscillation of the strings by electromagnetic fields only oscillations of small amplitudes are achievable.

SUMMARY OF THE INVENTION

The invention has an object due to the limitations of known instruments, to provide an instrument which has less limitations, thus opening up new possibilities.

When solving the problem, it has been recognized that a string instrument according to the invention should combine the sound quality of an acoustic string instrument with the varied control facility of an output signal of an electric or electronic instrument or appliance, particularly of a synthesizer, keyboard, computer, MIDI-appliance microphone or also of any loudspeaker output. In the known acoustic string instruments, the strings are excited by striking, plucking or bowing, the strings being started to oscillate due to this mechanical excitement by free oscillation or resonance having corresponding proportions of overtones. The spectrum of overtones plays an important role for tone color, but cannot, or only to a restricted extent, be employed by mechanical excitement in a controlled manner. Now, if in the case of the string instrument according to the invention an advantageous contact-less excitement is used instead of a mechanical excitement of the strings, particularly with exciting frequencies within the whole audible frequency range, the spectrum of overtones of the strings can be excited in a controlled manner. Thus, signals can be used for controlling the string instrument according to the invention which excite directly overtones with selected intensity which is not possible with mechanical excitement. In acoustical instruments, when playing tones with flageolet grips, the ground color is dampened after exciting this ground tone so that the overtones become audible. When doing this, an overtone can never sound in the same quality or as a sine tone, as it is the case if it is excited directly by the instrument according to the invention. The number of overtones increases considerably towards top tones, so that in the second octave above the ground tone two overtones may be played, in the third octave four, in the fourth octave eight and in the fifth octave sixteen. Only part of these overtones correspond to a tone of a tempered tuning, i.e. in the second octave two, in the third octave three, in the fourth octave five and in the fifth octave seven. With an acoustical music instrument, the phenomenon of overtone dynamics in the sound development plays an important role which should not be the case with a loudspeaker.

An instrument according to the invention comprises at least one tunable string, a holding device for holding the at least one string, an electrically or electronically operated exciting device for contact-lessly exciting of the at least one string, a sounding body for acoustically radiating oscillations of the string, and an interface for supplying a signal to the exciting device, the signal being generated independently from the at least one string. The exciting device enables exciting string oscillations of sufficiently large amplitudes so that the sounding body is enabled to radiate tones of a loudness which is at least within the range of known acoustical string instruments, the loudness range for a high loudness preferably extending beyond the maximum loudness of known acoustical string instruments. For transferring the string oscillations onto the body, at least one transfer element, preferably a bridge, is arranged between the body and the at least one string.

The electroacoustic music instrument according to the invention has the quality of an ability of resonance and of discrete overtones, and enables a synthesis of an acoustical tonal beauty with electronic flexibility. By exciting the strings of an acoustic instrument in a contact-less manner, an effect results which is far beyond that of an electric control of a mechanical exciting device. It is not the known way of playing of an acoustical instrument which is striven for, but a new instrument is provided which overcomes the limitations of known instruments and appliances.

For holding the at least one string, a holding device is provided which, preferably, comprises two lateral parts and at least one supporting column, the supporting column being situated between the two lateral parts. The at least one string extends from one lateral part to the other and is tensionably connected with one lateral part at one end. In order to be able to achieve loud tones, it is suitable, to prestress each inserted metal string with a tensioning force within the range of 200 to 1000, particularly 300 to 700, preferably substantially 500 N. If, for example, 24 strings are provided, the holding device has to bear a tensioning force of up to 12,000 N. To avoid that a single extremely massive supporting column has to be used, optionally a plurality of tubes and/or profiles are arranged substantially side by side. In order to prevent that the holding device starts oscillating caused by the oscillating strings, thus generating undesirable noise, damping elements are assigned to the holding device. For example, at least portions of hollow signed to the holding device. For example, at least portions of hollow supporting columns may be stuffed or filled with rubber, particularly hard rubber. It has been found that the development of noise depends to a high degree on the two lateral parts. If stabilization ribs projecting towards the interior are provided on the lateral parts, they should be formed as a pair, and the interspace should be stuffed or filled with rubber, particularly hard rubber.

In order not to affect the radiation of sound by the supporting column, the resonance body is arranged between the strings and the at least one supporting column. The surface of the resonance body which faces the strings is formed by a membrane. To transfer the string oscillations to the membrane, a bridge is provided on the membrane over which the string is prestressed. The resonance body is formed separated from the holding device and is attached to it in such a manner that the oscillation possibility of the body, and particularly of its membrane, is substantially not affected by the holding device. The body can be formed by a two-dimensional membrane which, optionally, has a shape deviating from a flat surface. Preferably, a hollow body is used which comprises a casement (or frame) closed in shape, where on one of the front surface of the casement the membrane is attached, while on the other front surface a bottom is fixed. Optionally only ribs are attached to the membrane instead of a casement. It will be understood that optionally the holding device may also be formed by the body, particularly by its casement. However, the holding device, in the case of a plurality of strings, particularly strings which are prestressed with a high tensioning force, has to have a high stability which will be achieved preferably by a holding device separated from the body.

In order that the membrane has particularly good oscillation properties, it is produced from sounding timber having narrow annual rings, and is connected to the casement in pre-stressed condition. In sounding timber, the annual rings are perpendicular to the surface of the timber, the fiber direction of the sounding timber extending in a first direction of the membrane surface, while in a second, perpendicular direction of the membrane surface one annual ring follows the other. The membrane will be less flexible in the first direction than in the second one. A flat membrane, as flexible surface in unstressed condition, cannot receive oscillation, transferred to it through the bridge, in an optimum way. Therefore, it is slightly bent at least in the second direction, but preferably also in the first direction and is, thus prestressed, fixed to the casement. The front surface of the casement, which faces the membrane, is curved in correspondence with the desired bending of the membrane. Preferably, four parts of the casement forming a rectangle together are provided. The first direction of the membrane extends in the direction of the longer side of the rectangle. The second direction of the membrane extends in the direction of the shorter side of the rectangle. Correspondingly, the front surfaces of the shorter parts of the casement are curved more than the front surfaces of the longer parts. Thus, the membrane will have the shape of a partial surface of a torus or of a ton body, this toroidal surface protruding preferably towards the string, thus radiating under a larger spatial angle than a surface which would be bent towards the interior of the body. A body having the pre-stressed membrane, as described, ensures a particularly efficient reception and acoustical radiation of the string oscillations transferred via the bridge.

It will be understood that the parts of the casement can also be arranged to form a different polygon, for example a quadrangle without a right angle or a hexagon. The membrane will have a correspondingly different form. Differently formed bodies may also be desired either due a better radiation characteristic or due to a different design.

In order not to impede oscillation of the membrane, at least one opening is formed in the body by which an air exchange is enabled from the interior of the body to ambient. In order not to change in a negative way the stress distribution in the membrane by the opening the at least one opening is formed within the region of the casement so that the proportion of sound exiting through the opening also enters the half space adjacent to the membrane and emerges in forward direction.

If only one string is used, solely tones of the spectrum of overtones of this one string can be radiated off which form a very limited spectrum of tones particularly within the range between the ground tone and its second octave. In order to be able to play pieces, which have been written for known string instruments, with the instrument according to the invention, it is preferred to use a chromatically tuned set of strings. To this end, an individual instrument could be provided having, for example, a chromatic set of strings over two octaves. Such an individual instrument which comprises an alto octave and a bass octave would encompass, for example, strings of a tuning g to f sharp' and contra G to F sharp. Preferably, however, register instruments having each 12 chromatically tuned strings which encompass one octave are built. The register instruments can be provided as a soprano, alto, tenor, bass or contra-bass instrument. Since the overtones of each string can be particularly well excited by the contact-less excitement up to a high pitch, one can make music even with a single register instrument, starting from the deepest tone up to very high pitches in all 12 keys. Apart from the chromatic tones of a tempered tuning, a variety of overtones is at disposal, whereby the most divers and special tone colors can be produced. In order to enable achieving a great loudness which may be excited to a maximum, optionally at least two strings are used at least for individual pitches. For example, it has been found in the case of bass strings that the achievable loudness is doubled, if two strings laid directly side-by-side and being excited by the same exciting device. In the case of high pitches, particularly of an alto level or a soprano level, it may be convenient to assign to each exciting device three equally tuned strings.

A register instrument according to the invention comprises a range of tones of 5 to 6 octaves due to the purposefully playable overtones. A bass instrument and an alto instrument together gives, therefore, about the register of a piano. In contrast to a piano, more mobility is ensured by the instrument according to the invention considering its weight and size. The register instruments can be distributed in a room whereby a multifunctional open system is at disposal in which a flexible interior design has also some importance.

An electronically operated exciting device for contactlessly exciting the at least one string comprises preferably an electromagnet on each sides of the at least one string. The exciting devices known in the prior art and comprising an electromagnet only on one side of the string are not able to ensure the preferred high exciting forces or high accelerations of the string, at least not with a reasonable exciting power. In the case of a one-sided exciting device, the magnetic field energy cannot be used in an enough efficient way for deflecting and accelerating the string. To use the magnetic field energy efficiently for accelerating a string, a system having two coils is used, the string to be excited extending through an air gap between the two coils.

In order to enable the magnetic field of the coils to exert a force onto a string, the string has either to be traversed by a current or it comprises a magnetizable material. Onto a string, which is traversed by a current, the Biot-Savart force is acting in a magnetic field in a direction perpendicular to the magnetic field and to the string so that a deflection of the string can be expected transversely to the axis of the coils and, thus, in longitudinal direction of the air gap. If the string comprises a magnetic or magnetizable material, particularly ferromagnetic material, a deflecting force can be transferred to the string by a magnetic action of the magnetic field. From the energy density of the magnetic field with the string or from the Maxwell voltage of the system a resulting force within the non-homogenous field is obtained which acts alternately in opposite directions by the variable magnetic field. The deflection of the string is in the direction of the axis of the coils and, thus, alternately towards one of the coils and transversely to the air gap.

When the string is be traversed by a current, only a faint excitation can be achieved. The force, with which the magnetic field acts onto the traversed string, can be formulated as follows:

$$F=i(\vec{l}\times\vec{B})$$

wherein

F: Force acting onto the string [N]

i: current through the string [A]

I: length of the conductor section subjected the magnetic field [m]

B: magnetic flux density [T]

If the string and the vectors of the magnetic field are perpendicular to each other, the following deflection force will be obtained:

$$F=iIB$$

The necessary magnetic field is generated by two coils coupled in the same direction. No permanent magnet is required. The string is in the middle of the air gap, where an approximately homogeneous field having lines of magnetic flux in the direction of the common coil axis exists. A changing force effect is caused either by a changing magnetic field B or by a changing current i trough the string. With this principle, one should take care that no heat is produced by the current flux through the string. This would lead to expansion of the string, and the instrument would be out of tune. With a maximum of tolerable current flux through the string of i=1A, a length of the magnetic exciting device of 10 mm and a desired force effect onto the string of F=0.1N, a magnetic flux density of 10T in the air gap is necessary. This is, particularly with a required air gap of about 5 to 6 mm not realistic.

The calculation has been confirmed by experiment and a simulation. The effect of force occurring between a current traversed string and a magnetic field cannot enable a sufficient excitement of a string at reasonable expenses. The flux density of the magnetic field which can be achieved is insufficient to deflect the string in lateral direction. In addition, if the string is not perfectly centered in the air gap, an uncontrolled force will occur in the direction of the axis of the coils. This force, in the oscillating magnetic field, has a share of oscillation so that the string starts oscillating. The string, however, is also drawn towards the closer coil and, in case of a distance too small, will contact it. The reason is that the string is formed of magnetizable material. If the magnetizable material of the string has a small remanence and is of low retentivity, the attraction force described will occur independently from the momentary direction of the magnetic field.

In order to be able to generate a sufficiently large exciting force at reasonable expenses, a string is used which comprises a magnetizable material, particularly a ferromagnetic one, and is preferably formed thereof. Providing at least one permanent magnet and two coils arranged at both sides of a string, an inhomogeneous magnetic field in the region of the string and, thus, a deflection force can be achieved, as has already been mentioned above. For illustration, one may imagine that the at least one permanent magnet in the air gap and, thus, in the region of the string, creates a strong magnetic field which takes over a kind of a potential function. In order to start the string oscillating within this permanent magnetic field, the coils generate non-homogeneities in the magnetic field according to the exciting signal. The coils are wound in opposite direction and generate in the case of a current flow magnetic fields, which are opposing each other with equal poles. The non-homogeneous magnetic fields in the air gap, alternating according to the current's direction, develop corresponding forces acting onto the magnetizable material of the string. If a current flows through the coils, the magnetic field in the air gap will change. Where the field generated by a coil has the same direction as the static field, the flux density becomes stronger; on the other side of the string, the fields are opposite each other which leads to a fainter magnetic field. Due to this asymmetry, a resulting force will act onto the string.

To provide a permanent magnetic field as strong as possible, preferably two permanent magnets are used. In a first embodiment, the two permanent magnets are each located in a coil and, thus, at both sides of the air gap. However, this arrangement has the disadvantage that the permanent magnets are situated where the electromagnets have the highest flux density which, in the case of strong alternating fields of the electromagnets, may lead to demagnetization of the permanent magnets. The electromagnets and the permanent magnets create closed lines of magnetic field which are subjected to a high resistance within the air gap and around the electromagnets in air. By using magnetizable cores, particularly iron cores, which, apart from the air gap with the string, offer a closed path for the lines of magnetic field, the resistance of the magnetic fields and the proportion of air space wherein the lines of magnetic field will develop and, thus, the resistance against the magnetic field will be reduced. In addition, the permanent magnets can be inserted into the closed path of the core portion, outside the coils, whereby they are subjected to a smaller field density of the magnetic field generated by the coils. When constructing, one should take care that the field strength produced by the electromagnets is smaller at the permanent magnets than the coercive field strength of the permanent magnets so that their magnetization is not affected. The resistance for obtaining alternating magnetic fields can be still more reduced by forming the core portion from interengaging core sheets having an electric isolation, whereby the occurrence of eddy current is significantly diminished.

By superimposing the fields of the permanent magnets and the electromagnets, a non-homogeneous field will develop in the air gap comprising the string. The force effect of the non-homogeneous field onto the string may be described, starting from the Maxwell voltage, as follows:

$$F=\tfrac{1}{2}\oint \vec{B}\,\vec{H}\,d\vec{A}$$

By integrating over a system border G encompassing the string, the force effect of the magnetic fields of the coils and the permanent magnets onto the string can be described. An estimation of the resulting force shows that it depends on the field strength of the permanent magnets and the field strength of the coils. By using permanent magnets of high magnetic flux density, the efficiency of the exciting device can substantially be increased. If it is required to achieve an amplitude of the string as large as possible by a small effective power fed to the electromagnets, permanent magnets of a quality as high as possible have to be used, such as samarium-cobalt (SmCo) magnets or neodymium-iron-boron (NdFeB) magnets. In this way, the efficiency can at least be doubled as compared with ferrite magnets. A permanent magnet to be employed with advantage should enable a high magnetic flux density and should not be sensitive against interfering fields, or should have a sufficiently high coercive field strength.

For generating an non-homogeneity in the magnetic field, it would also be conceivable to use only one coil in which case the force acting onto the string would be smaller with equal coil current. With a higher coil current, a greater local development of heat would occur. In addition, with only one coil, one could not obtain an analogous non-homogeneity at the averted side of the string as at the side of the coil. Correspondingly, the excitement towards the coil and the excitement away from the coil with equal intensity of current would be different which would provoke an asymmetric excitement by a sinus signal. Therefore, an exciting device of symmetric construction with respect to a center plane is preferred, the center plane extending through the axis of the string and perpendicular to a common axis of the coils.

An exciting device having two E-shaped core parts being interconnected at the two outer projections each through a permanent magnet and comprise each a coil at the center projection enables an extremely efficient excitement of strings. By narrowing or widening the center projection, the field strength in the air gap and the extension of the field in the direction of the string can be varied. If, for example, oscillations of a small wave length should be excited, it must be ensured that the extension of the magnetic field in the direction of the string is substantially not larger than half the wave length of that tone which has the shortest wave length that should still be possible to excite. If this desired extension of the magnetic field is smaller than the diameter of the magnets used, the magnetic field emanating from the permanent magnet may be narrowed by a narrowing the core part at the center projection to the desired extension. Since E-shaped core sheets are on the market, and since high-quality permanent magnets, such as samarium-cobalt (SmCo) magnets or neodymium-iron-boron (NdFeB) magnets, are available at low costs, the advantageous exciting devices can be produced at low expenses. It will be understood that, instead of two assembled E-shaped cores, two C-shaped cores per string could be assembled, wherein two projections assigned to each other are interconnected by a permanent magnet, while the other two projections assigned to each other are each provided with a coil. Optionally, cores having more than three projections, for example 13 or 14 projections, are assembled, in which case a permanent magnet is inserted at least between two projections assigned to each other, while between each of the other pairs of projections an air gap and a string is arranged and on each of the projections of these pairs of projections coils are arranged wound in opposite directions. In this way, the permanent magnetic field emanates for all air gaps from a common magnet, the supply of the magnetic field to the air gaps being effected through the core parts. It will be understood that the at least one common magnet could be formed as an electromagnet. Arrangements with 13 or 14 pairs of projections can be used in chromatically tuned sets of strings comprising 12 single or multiple occupied strings, if the free spaces between the strings are too small to insert the connecting portion of a core part or a permanent magnet. Optionally, such arrangements can be used in known instruments having metal strings, such as a piano.

In order to be able with an instrument having a plurality of strings to excite individual strings quickly and strongly, preferably one exciting device including two coils, at least one permanent magnet and two core parts interconnected via the at least one permanent magnet is assigned to each string, but optionally to each set of two or more equally tuned strings. It will be understood that the permanent magnetic field, whose lines of magnetic flux extend mainly through the core parts, could also be produced by a current-traversed coil arranged around at least one core part. If due to an electrically produced permanent magnetic field no permanent magnet is inserted between the core parts, optionally one core part may be sufficient. Model calculations and tests have shown that a string reacts in a sensitive manner to changes of frequency. Even small deviations of the exciting frequency from the natural frequency of the string make coupling worse to a high degree. Thereby, overtones being close to each other could be excited purposefully and individually.

Even if the instrument is constantly operated with large amplitude string oscillations, the temperature at the exterior of the coils does not increase above 50° C. This good thermal property results from that sufficiently strong exciting forces can be achieved even with small power supplied. Moreover, the system has good thermal conductors by the core parts which dissipate heat developing at the coils to the exterior.

By using closed arrangements having core parts and inserted high-grade permanent magnets, the efficiency can be raised, in comparison with approaches using ferrite magnets in the coils, by a factor of 10 to 15. An efficiency as high as possible permits starting quickly the strings oscillating with extremely strong oscillation at reasonable energy expenditure. This is necessary, if the sound of the string's oscillation has to be radiated acoustically, and in particular if the instrument according to the invention has to provide the sound of a plucked bass string. High efficiency enables a good coupling of the string oscillation to the exciting signal. In this way, both the frequency characteristic and the amplitude response curve can be controlled.

The exciting device does not only enable the initial excitement of a string's oscillation, but also controlling the course of the oscillation, particularly also a deadening of the string's oscillation. To achieve selective deadening, preferably the actual oscillation is detected, an exciting signal of opposite phase is provided to excite the string with it. Detecting the actual oscillation may either be effected by a separate pick-up, by detecting the deflection optically at the exciting device used for deadening, or through a signal detected by the exciting device. If oscillations of different frequencies should be deadened in a different fashion, measuring the amplitude should be done in dependence on frequency.

It will be understood that instead of active deadening by an exciting device, mechanical deadening can also be provided. Mechanical deadening is effected by means of muffling elements that can be moved to the string. Preferably a mechanical deadening device comprises two muffling elements for each string which can be moved to the string from opposite sides. For driving the dampers, an electro-mechanical system may, for example, be provided, by which either each individual string or all strings together can be muffled.

The electromechanical system encompasses electromotors and/or electromagnetic lifting devices, particularly lifting magnets which can be positioned.

Each exciting device is operated via the interface, a signal from outside being fed to at least one input of the interface. The interface is preferably designed in such a manner that substantially any electric or electronic signal, be it analogue, digital or even in MIDI-format, particularly signals of synthesizers, keyboards, computers or signals of micro-phone or loudspeaker outputs, can be input. In order to provide MIDI-signals appliances, such as master keyboards, MIDI-sax, MIDI-guitar or other MIDI-controller are available for various instrumental techniques. To enable a versatile conversion of different electrical signals, the interface comprises preferably, apart from at least one MIDI-input, a plurality of parallel sound inputs, particularly to be switched from analogue to digital or vice versa. In order to be able to use signals from a microphone for controlling the instrument according to the invention, at least one microphone input is provided. For example, the sound of a violin may be used for controlling purposes via a microphone input. If a signal for controlling individual strings of an instrument, having a chromatic set of strings, is provided, it is suitable to use an interface having a chromatic input. Since, in the case of strings of a long oscillation period, deadening the strings is important for a good sound quality, the interface comprises preferably a deadening input or a pedal input which, for example, is connected to at least one deadening pedal. Via the deadening input, the muffling characteristic of the mechanical dampers and, optionally, of contact-less deadening by means of the exciting devices is influenced, for example by omitting or weakening the muffling effect when pressing the pedal.

The interface, starting from the input signals, produces control signals for the exciting devices or for amplifiers of the exciting devices. In the simplest case, an input signal is directly fed to the exciting devices so that the interface has to be considered only as a signal input. If the signals, which are used via a microphone or sound inputs for controlling the instrument, are not compatible with the characteristics of the instrument, the sound quality may be optimized by using filters and by two different methods of exciting. A first method, called resonance mode, uses a common exciting signal for simultaneously controlling all exciting devices, the strings, in correspondence with their natural frequencies and spectra of overtones, responding only to those signal portions having the natural frequencies of the respective strings. A second exciting method, called tone apportion mode, assigns the tones of the signal to those strings on which these tones will sound. Correspondingly, the signal portions are each fed to the appropriate exciting devices and/or to their amplifiers.

An amplifier of an exciting device should have a high efficiency so that a power proportion as high as possible is converted into an excitement of a string, while a small power proportion is converted into heat. In order to dissipate heat developing by the stray power, normally cooling is necessary which leads to large dimensions of the amplifier. In order to improve the effective output, preferably an amplifier of class D is provided. Amplifiers of class D are based on the principle of pulse width modulation and are described by B. Schweber, Class D IC-Amps: Ready for audio prime time", EDN magazine, Jul. 1, 1999. The input signal either switches the output in or out. The amplitude of the output signal is controlled by the pulse width. The reason for the high efficiency to be achieved resides in the binary action of the circuitry: Losses are mainly produced by power switches. In contrast, the stray power in AB amplifiers develops, among others, already by the adjustment of the operating point. The efficiency of class D amplifiers to be attained is in the range of 80 to 90%. When applied in the audio-field, special output filters are necessary for the use of these amplifiers to minimize the nonlinear distortion factor. Since the exciting device itself has already a quite high inductivity, this is not necessary in the case of the present instrument.

In order to be able to design an amplifier for controlling an exciting device, the required frequency response has to be known. For this reason, the frequency response of the system, comprising the exciting device and the string, has to be determined. Since the power requirements for an amplifier for exciting a bass string are particularly high, exciting a bass string has precisely been analyzed. The measured relative acoustic pressure shows that above a frequency of about 6 kHz no oscillation of the bass string can be determined. From a frequency of about 5 kHz on, the oscillation of the bass string is superimposed by a hum of the inducing coils. With higher frequencies, the interval between the resonances is no more precisely $\lambda/2$ which can be explained by the physical properties of a bass string, especially the fact that the nodal points are not infinitely small. The low-pass characteristic of the system in the frequency response could clearly be seen. This may be explained by the inductive charge of the exciting device. If the string to be excited is not sufficiently strongly prestressed, particularly also with low frequencies a bad transfer of the string's oscillation to the body can be observed. To achieve a good efficiency with a contact-less exciting device in a lower frequency range, the strings have to be prestressed sufficiently well.

In order to convert even high-frequency signal proportions into a sufficiently loud sound, an equalizer is preferably pre-posed to the amplifier and raises the high frequencies. A limitation of the frequency response is caused by the inertia of the string. In addition, in the case of high frequencies, half the wave length is within the range or below the extension of the exciting device or the inducer's length. With a test string oscillating at 6 kHz, $\lambda/2=12.5$ mm. Thus, with an inducer's length of 10 mm the limit of a reasonable excitement of a string is reached. Therefore, if no tones above 6 kHz can be produced, the amplifier has to show a linear characteristic only below 6 kHz. Such pulse width modulation amplifiers of class D are on the market. Therefore, a contact-less exciting device can achieve a string's oscillation at a high efficiency, thereby covering sufficiently large frequency ranges and loudness ranges.

Up to now, the composition and improvization techniques using computers had only the electronically generated sound radiated by a loudspeaker at disposal. By the instrument according to the invention, such compositions obtain a new and excellent sound effect through the natural string sound and its radiation from the wooden body.

In order to protect the instrument and/or to influence its radiation of sound, preferably an envelope is provided. The envelope is connected to the holding device and comprises at least one two-dimensional, preferably curved, directional element that may be used for limiting the portion of space into which the sound from the body is radiated off. To enable the envelope its protective function, it comprises a bottom portion at the rear of the body averted from the strings, and an adjacent wall portion surrounding the body. The at least one directional element can preferably engage the wall portion to form a lid so that the envelope surrounds the body completely. In a particularly preferred embodiment, lamellar directional elements are guided by a guiding device. The directional elements may, for example, be oriented substantially in the direction of a dominant radiation direction. Optionally, the directional elements may form deviating surfaces which extend, for example, under an angle of substantially 45° to a horizontal plane from a horizontally oriented body above this body, thus deviating the sound, that emanates from the body dominantly in vertical direction upwards, in a horizontal direction.

In the case of instruments having metal strings sufficiently strongly prestressed, an exciting device for contact-lessly exciting at least one string may advantageously be used. This means that at least one string of the known instrument may be controlled, after incorporating the exciting device, via an interface by the supplied electric or electronic signal. In this case, the string must comprise a magnetizable material. The exciting device to be used comprises two coils at both sides of an air gap for receiving the string which are arranged about a common coil axis, and a magnetic device for generating a permanent magnetic field, preferably at least one permanent magnet. The permanent magnetic field in the region of the air gap is substantially parallel to the coil axis, and the coils are wound and connected in such a manner that in a current traversed condition they generate magnetic fields of equal, opposite directed poles so that an non-homogeneous magnetic field will be achieved in the air gap which enables the string to be biased by a deflection force.

In particular, it would also be possible to build an electric instrument having a chromatic set of strings and contact-less exciting devices, the sound being radiated through pick-ups, amplifier(s) and loudspeaker(s). Certainly, the sound quality would be worse, but the exciting possibilities due to the exciting device, and particularly the possibilities of deadening described, could be advantageously used for producing sound.

BRIEF DESCRIPTION OF THE DRAWINGS

The invention is described with reference to embodiments shown in the drawings in which:

FIGS. 16*a*–*d* schematic illustrations of an instrument envelop.

DETAILED DESCRIPTION OF THE PREFERRED EMBODIMENT

Figure 1:
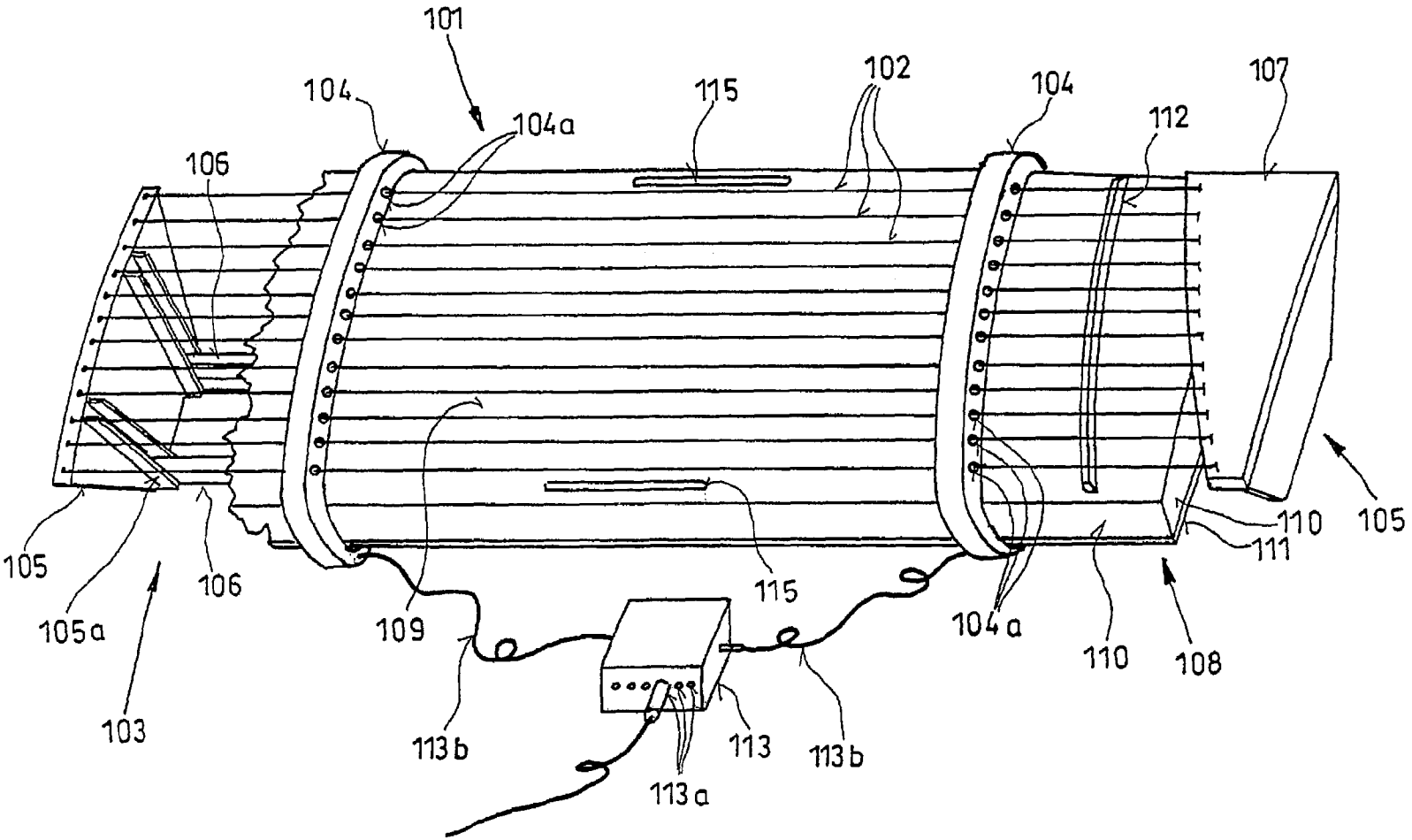
FIG. 1 is a perspective view of a string instrument comprising a contact-less exciting device.
Figures 2, 2A, 2B, 2C:
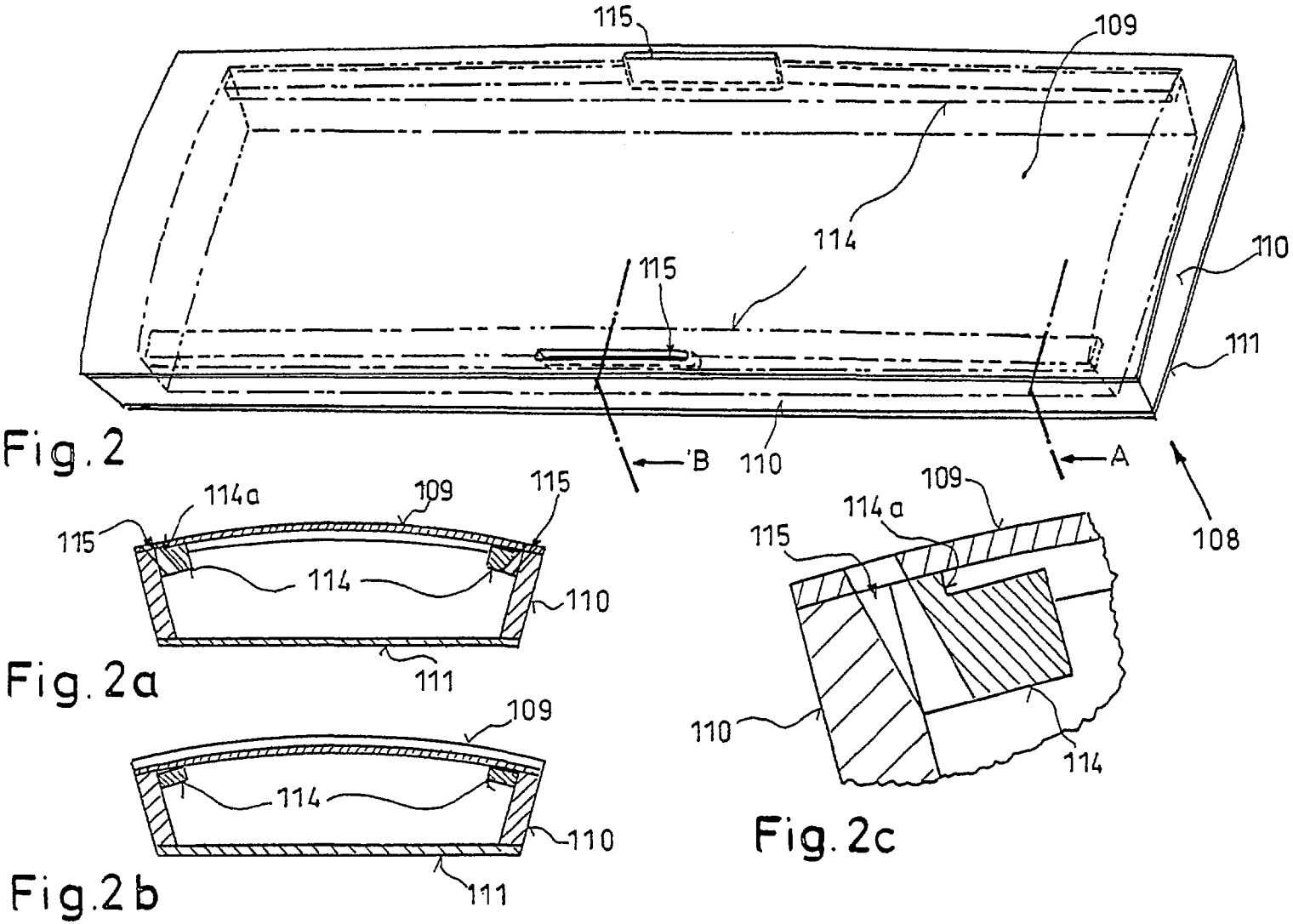
FIG. 2 a perspective view of a sounding body.
FIG. 2*a*, 2*b* cross-sectional views along the lines A and B of FIG. 2.
FIG. 2*c* a detail of FIG. 2*a;*

FIG. 1 shows an instrument 101 according to the invention which comprises 12 chromatically tuned strings 102 tensionably held by a holding device 103. In a preferred embodiment, at least two directly adjacent strings or a multiple set of strings is assigned to each tone. To start the individual strings or the multiple sets of strings oscillating, an electrically or electronically operated exciting device is assigned to each string 102 or to each multiple set of strings. For holding the exciting devices, at least one support 104 having through holes 104 for the strings 102 are provide. Optionally, two supports 104 including exciting devices in different positions along the strings 102 are arranged. Since the resonance oscillations cannot be excited in the region of their nodes, different natural oscillations of the strings 102 will be excited differently well at the different positions. Moreover, the exciting devices of one support 104 may be designed in such a manner that, in comparison with the exciting devices of the other support 104, they act over a larger length with exciting forces onto the string 102 and, thus are better adapted to excite oscillations of a greater wave length.

The holding device 103 comprises two lateral parts 105 and at least one, preferably two, in particular however three or more, supporting columns 106 connected to the two lateral parts 105. The strings 102 are arranged between the two lateral parts 105, a respective tensioning device being provided on one lateral part 105 for tensionable attachment. One lateral part 105 comprises a diapason plate 107 so that the string length increases in steps from a shortest string to the longest string. To be able to absorb the high tensioning force of all strings, ribs 105*a* are formed at the lateral parts 105, facing the interior and being connected to the supporting columns 106. To prevent undesirable development of noise, the ribs 105*a* are preferably formed as double-ribs having an intermediate layer of hard rubber, and at least a portion of the supporting columns are filled with hard rubber. The supports 104 together with the exciting devices are attached to the supporting columns 106 and may be a bit displaced so that the strings 102 are directed through the through holes 104*a* in a substantially centered way.

For acoustically radiating the string oscillations, a sounding body 108 is provided. This body 108 is formed as a hollow body and comprises a membrane 109, a casement 110 closed in ring form and, particularly, a bottom 111. The membrane 109 is arranged at one front surface of the casement 110, while the bottom 111 is at the other front surface. The membrane faces the strings 102, the strings 102 engaging a bridge 112 which, in turn, is in contact with the membrane 109. The sounding body 108 is fixed to the holding device 103, particularly to the support columns 106, by a spacing adjustment device (not shown) having rubber elements. By means of the spacing adjustment device, the stress with which the strings 102 engage the bridge 112 can optimally be adjusted.

For supplying signals to the exciting devices in the supports 104, at least one interface 113 is provided to which the control signals can be fed through at least one input 113*a*. Cables 113*b* lead from the interface to the exciting devices.

To ensure a high sound quality of the instrument 101, a new, simply constructed sounding body 108 having a pre-stressed membrane 109 has been developed. According to FIGS. 2, 2*a*, 2*b* and 2*c*, four parts of the casement (plinths) have been assembled to a rectangle and are connected to the bottom 111 at one front surface. The long lateral parts of the casement (plinths) 110 protrude a little outwards towards the membrane 109. To increase the stability of the long parts of the casement 110 at the membrane 109, longitudinal ribs 114 are fixed which project to the interior at the membrane 109, extend parallel to the membrane 109, but are spaced a little from it. In order to ensure that the membrane 109 has particularly good oscillation properties, it is produced from sounding timber having narrow annual rings, and is connected to the casement in pre-stressed condition. In the sounding timber, the annual rings are perpendicular to the surface, the direction of the fibers extends preferably in the direction of the large rectangle side, and in the direction of the small rectangle side one annual ring follows the other. The membrane 109 is slightly bent at least perpendicularly to the fiber direction, but preferably also along the fiber direction and, thus, is fixed to the casement 110 in a pre-stressed condition, particularly being glued to it. The parts of the casement 110 are bent at that front surface facing the membrane 109, the front surfaces of the shorter parts of the casement 110 being more bent than the front surfaces of the longer parts of the casement 110. The preferred bending radii depend on the timber quality and are, for a short side, below 1.2 m, particularly below 1 m, preferably substantially at 0.95 m. For a long side, the preferred bending radii are above 10 m, particularly above 12 m, preferably substantially at 14 m. In this way, the membrane 109 has the shape of a partial surface of a torus or of a ton body, this toroidal surface protruding preferably towards the string, thus radiating under a larger spatial angle than a surface which would be bent towards the interior of the body. The longitudinal ribs 114 prevent that the stress of the membrane 109 results in a deformation of the long parts of the casement 110.

In order not to change in a negative way the stress distribution in the membrane 109 by an opening, the at least one opening 115 for the exchange of air and the radiation of sound from the interior of the body 108 is formed, according to a preferred approach, in a middle region of the long parts of the casement 110. The opening 115 extends in form of a slot through the casement 110 and the longitudinal ribs 114. For holding the membrane 109 even in the region of the openings 115, a holding area 114*a* is formed on the longitudinal ribs 114 which projects up to the membrane 109.

Figure 3:
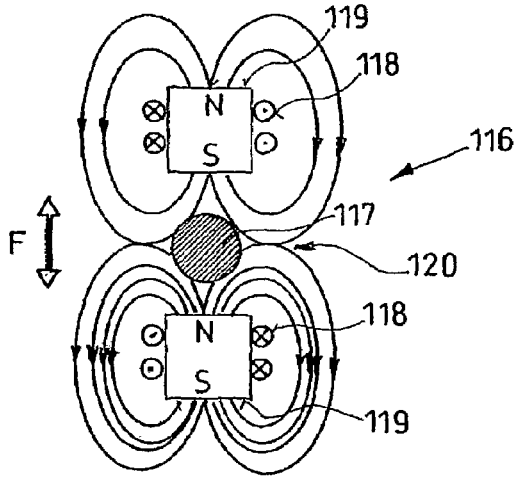
FIGS. 3, 4 schematic illustrations of exciting devices.

FIG. 3 shows an exciting device 116 by which an oscillating force F may be exerted perpendicularly to the longitudinal direction of a string 117 onto the string 117 which comprises magnetizable material. On either side of the string 117, coils 118, and within the coils 118 permanent magnets 119, are arranged. The two permanent magnets are equally oriented and generate a strong magnetic field in an air gap 120 with the string 117. To start the string in this permanent magnetic field oscillating, non-homogeneities are produced in the magnetic field by the coils in correspondence with an exciting signal. The coils 118 are wound in opposite directions and are connected in such a manner that magnetic fields are generated which are each directed with equal poles one against the other. In one or other current direction, the whole magnetic field density, resulting from the coils and the permanent field, is increase towards one or other coil. The magnetic fields in the air gap which, alternate in correspondence with the current direction, act with a corresponding force onto the magnetizable material of the string 117.

Figure 4:
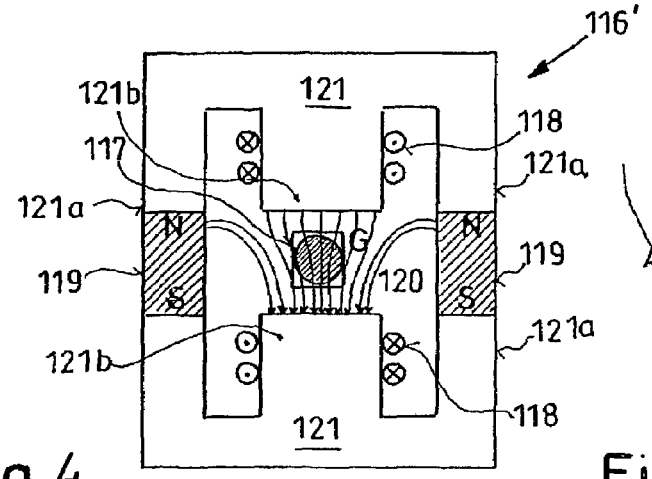
Figure 5A:
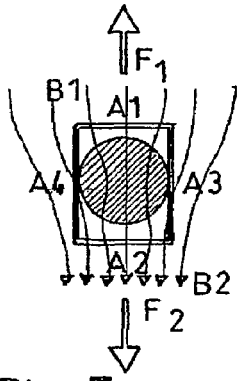
FIG. 5*a* a schematic illustration of the existing forces

FIG. 4 shows a preferred exciting device 116' wherein magnetizable core parts 121, particularly iron cores constructed of electro-sheet material, are inserted. These core parts 121 have the shape of an E and have the outer two projections 121*a* interconnected by a permanent magnet 119 each, while a coil 118 is arranged around each one of the center projections 121*b*. As in FIG. 3, the coils 118 are wound and connected in opposite directions. By narrowing or enlarging the center projection 121*b*, the field strength in the air gap 120 and the extension of the field in the direction of the string may be varied. By the core parts 121, the proportion of air, wherein the magnetic field lines develop, and, thus, the resistance against the magnetic field may be reduced. In this way, the field density can be increased in the region of the air gap 120. The superposition of the fields of the permanent magnets and the electromagnets 119, 118 results in the non-homogeneous magnetic field indicated in the air gap 120. The force of the non-homogeneous field acting onto the string 117 may be determined, starting from the Maxwell voltage, by integration over a system border G encompassing the string. According to FIG. 5*a*, for an estimation of the force in the direction of the common axis of the coils 118, the system border G is sub-divided into four partial surfaces A1, A2, A3 and A4, and it is supposed that the magnetic field perpendicular to the areas A1 and A2 has a substantially constant value of B1 and B2. In perpendicular direction to the areas A3 and A4, the magnetic field is imperceptibly small. In a first approximation, the forces F1 and F2 which act onto the partial surfaces A1 and A2 can be calculated as follows:

$$F_1 = \frac{A_L}{2\mu_0}(B_{d1} + B_E)^2$$

$$F_2 = \frac{A_L}{2\mu_0}(B_{d2} + B_E)^2$$

wherein $B_{d1}$, $B_{d2}$ are flux densities produced by the permanent magnets at the surfaces A1 and A2, $B_E$ are flux densities produced by the electromagnets at A1 and A2, $A_L$ is a surface, and $\mu_0$ represents a magnetic field constant.

The resulting force is calculated for $B_{d1}=B_{d2}=B_d$ as follows:

$$F=F_1-F_2=k(B_dB_E)$$

Thus, the exciting force increases both with the field strength of the permanent magnets and with the field strength of the electromagnets. Since $B_E$ in $F_1$ stems from one electromagnet 118 and in $F_2$ from the other, an arrangement having only one coil would result in a clearly smaller force to be achieved.

Figure 5B:
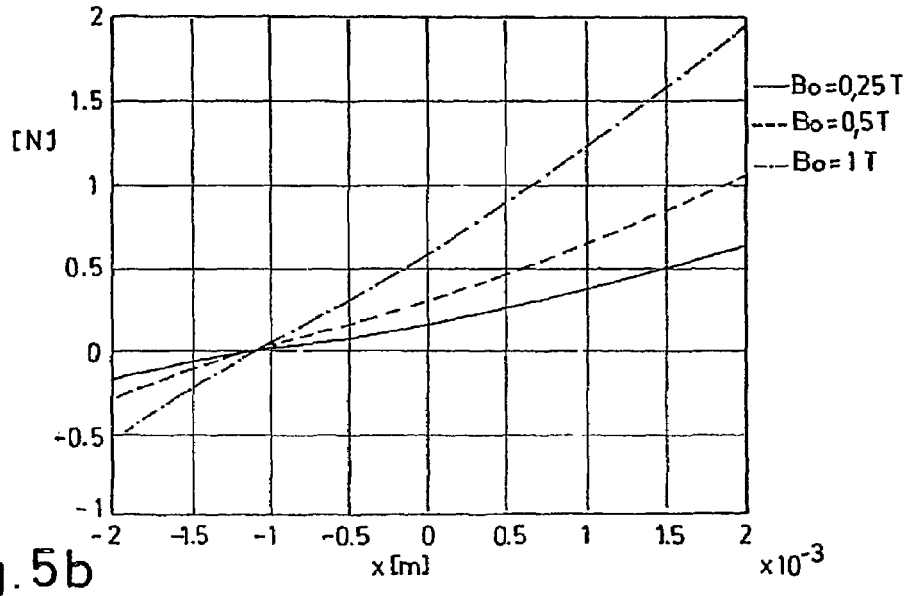
FIG. 5*b* a functional illustration of the force effect as a function of the deflection at different strength of the magnetic field.

FIG. 5*b* illustrates the force acting onto the string 117 as a function of the deflection in the direction of the axis of the electromagnets 118 for three different types of permanent magnets 119 which generate magnetic fields of 0.25, 0.5 and 1T in the air gap. In the center of the air gap and at a deflection of 0, the force is substantially proportional to the magnetic field of the permanent magnet.

Figure 6:
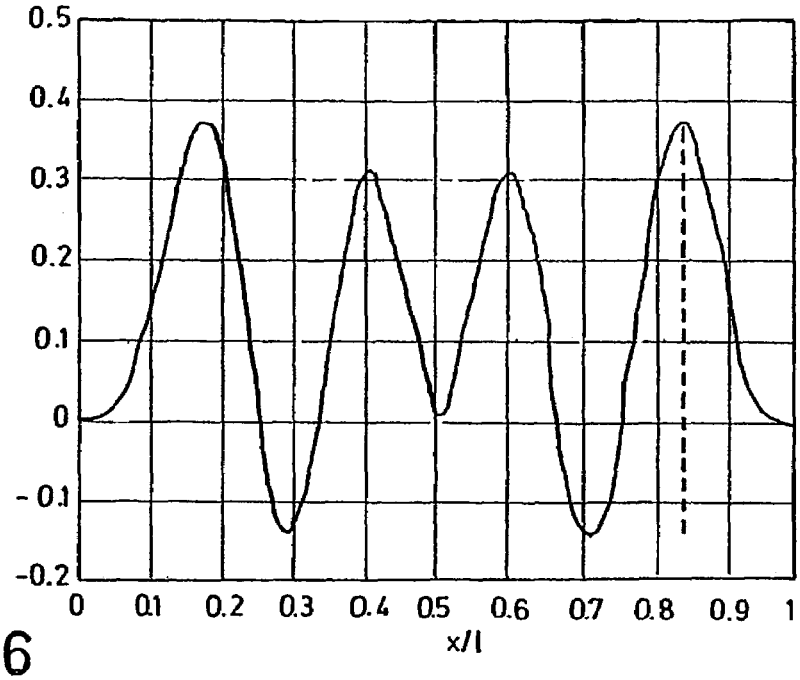
FIG. 6 a functional illustration of the exciting effect as a function of the position of the exciting device.

FIG. 6 illustrates that the position of the exciting device 116, 116' and of the support 104 along the string 102, 117 plays a decisive role. Mainly for exciting oscillations of a low frequency, it is important to have a sufficient distance from the next node, because with an increasing distance from a nodal point the available lever is longer so that with an equal force the deflection is wider. For the capability of being excited represented in y direction as a function of the relative position of the exciting device along a freely oscillating string, i.e. between the one lateral part 105 and the bridge 112, the lowest fourth partial oscillations have been taken into account. The exciting capability has an absolute maximum at a position x/l=0.83. This means that an optimum excitement of the lowest four partial frequencies is possible at this place. If higher natural frequencies of a string are encompassed by the calculation, the maximum shifts towards a position x/l=0.87. Thus, the strings may be excited in an optimum way either near the bridge or near the opposite lateral part.

Figure 7A:
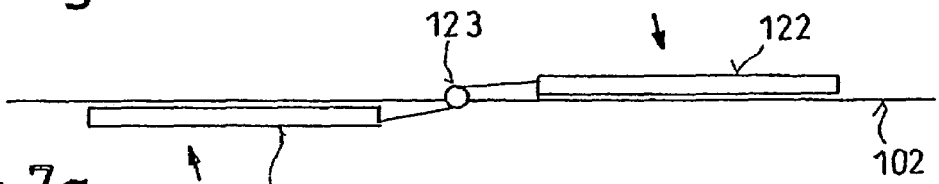
FIGS. 7*a*, 7*b*, 7*c* schematic illustrations of mechanically deadening.
Figure 7B:
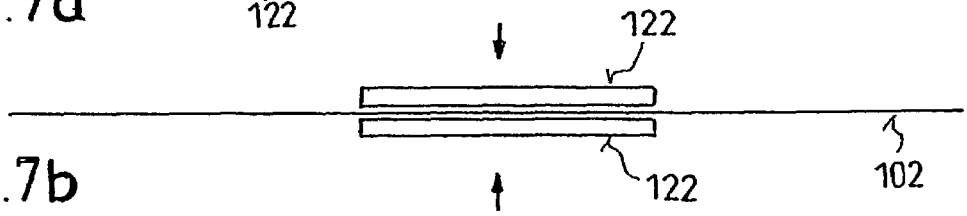

Since the strings 102, due to the high tensioning forces, hum for a long time, they have to be able to be deadened. FIGS. 7*a* and 7*b* show schematically two approaches for mechanically deadening a string 102. Mechanical deadening is effected by means of two dampers 122 which approach the string from two sides. According to FIG. 7*a*, the dampers 122 are moved about a point of rotation 123 each at one side of this point of rotation to the string 102 and away. According to FIG. 7*b*, the dampers are moved towards each other, the string being able to be clamped between the dampers.

Figure 7C:
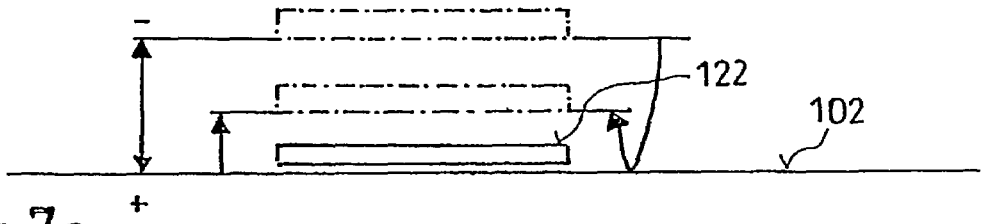

An electromechanical system serves for driving the movement of the dampers, the system being able to deaden both each string individually and all strings together. The manner of deadening, particularly the minimum distance of the dampers 122 from the string 102 is, for example, adjusted by a pedal or by any other control device. According to FIG. 7*c*, each damper can assume a position and exert a positioning movement in a range between a maximum deadening pressure onto the string + and the complete release of the string −. The actual position and/or a stroke of movement for deadening can be adjusted by the pedal. It is possible to exceed flexibly the zero point given by the pedal, particularly up to the maximum deadening pressure. In this way, violently oscillating strings may be deadened in an ideal fashion even when deadening is faint due to the position of the pedal.

The mechanical dampers comprise per string a deadening sole with a deadening shoe as well as an adjustment device for orienting the deadening shoe along the string and transversely thereto. Actuation of the dampers is effected by mechanical lifting devices having electromotors or electromagnets. To render deadening reproducible, the drive systems have to have a position control. Zero point adjustment is either effected by positioning the magnet systems synchronously or by a separate drive system.

Figure 8:
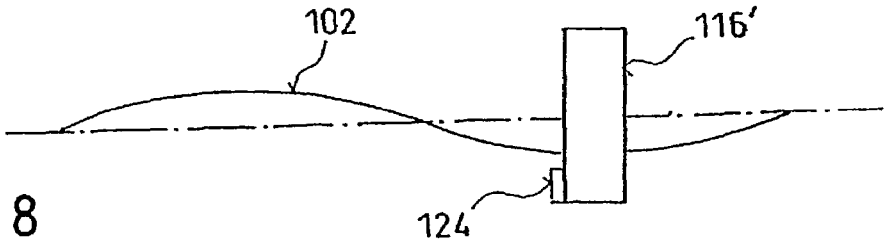
FIG. 8 a schematic illustration of a contact-less deadening.

FIG. 8 shows a deadening approach in which the oscillation of the strings 102 is detected individually and by exciting the strings 102 in opposite phase by an exciting device 116' in accordance with the string oscillation detected. To this end, the movement of the string is detected by a position measuring device 124, for example an optical distance measurement, but optionally by measuring at the exciting device, for example by measuring induction. From measuring the position, a velocity signal may be derived which may be used for generating a deadening force. The position or the movement of the string should be measured close to the exciting device or the deadening device, if possible.

For controlling contact-less deadening, preferably a control loop is used which predetermines the amplitude course of the string oscillation during the deadening procedure through a nominal function. By measuring the amplitude, the procedure of dying out may be monitored and, if necessary due to deviations, can be influenced. The measurement of amplitudes has to be insensitive with respect to lateral oscillations so that undesirable movements are not excited by the deadening procedure. If the amplitude measurement is done in a frequency selective manner, deadening may be carrier out in a frequency selective manner too. By contact-less deadening, willful canceling of a signal spectrum is possible. This function is not possible with a mechanical damper. For deadening in an optimum fashion, the transferred force should act onto an area with maximum amplitude.

Figure 9:
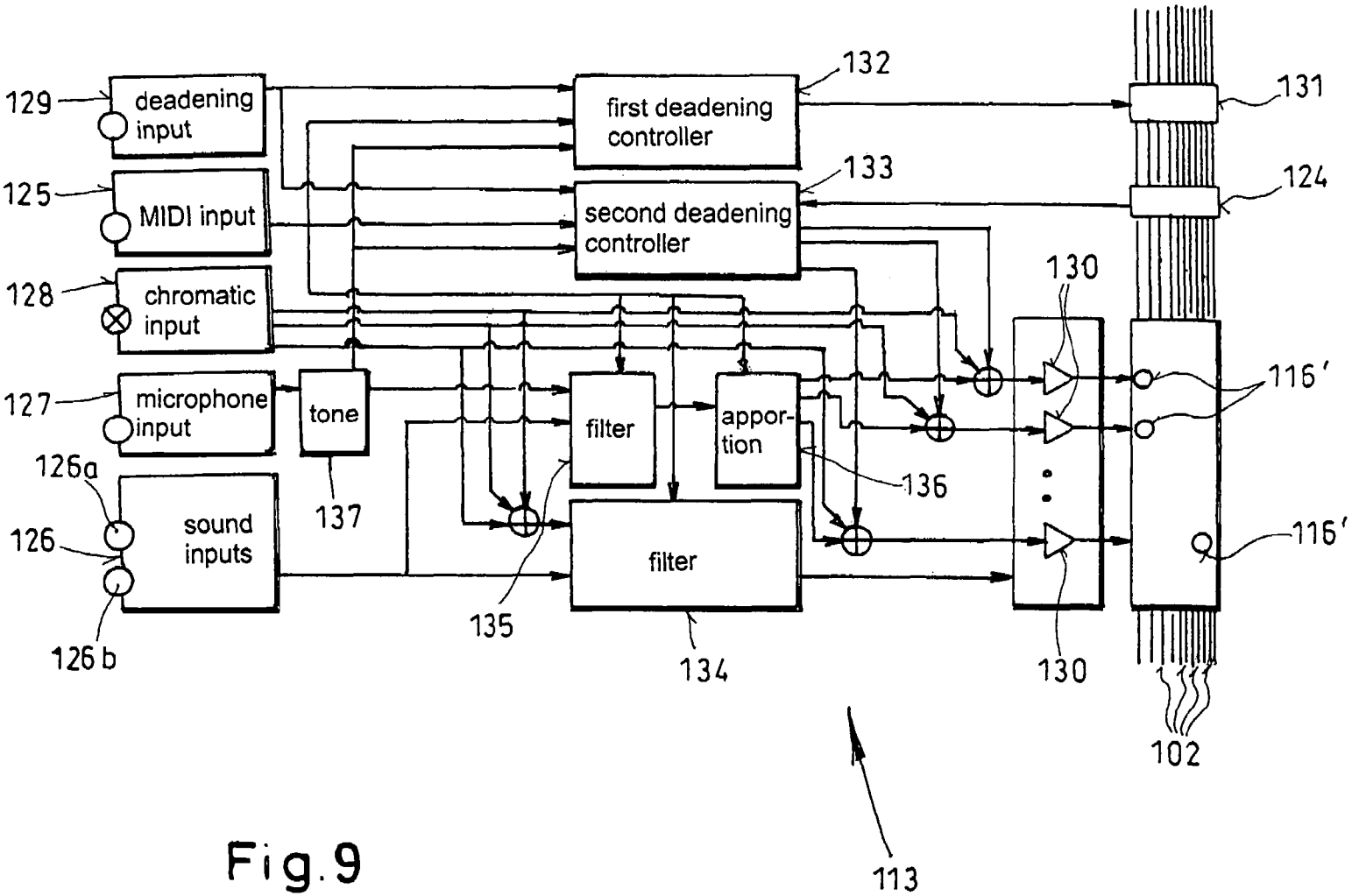
FIG. 9 a schematic illustration of an interface.

FIG. 9 illustrates an embodiment of an interface 113 having various inputs. Apart from at least one MIDI-input 125, a plurality of parallel sound inputs 126 are provided which are, in particular, switchable from analogue 126*a* to digital 126*b* and vice-versa. Preferably, at least one microphone input 127 is provided. For example, the sound of a violin may be used via a microphone input. If there is a chromatic signal for controlling the individual strings of an instrument having a chromatic set of strings, it is convenient to use an interface having a chromatic input 128 which results in an ideal assignment of the tones and, in particular does not lead to tone blending. Since with strings 102 having a long oscillation period deadening of the strings is also important for a good sound quality, the interface 133 comprises in particular a deadening input 129 which is, for example, connected to a deadening pedal. By the deadening input, the deadening characteristic of mechanical dampers and/or deadening by means of exciting devices are influenced, for example releasing or weakening the deadening action when the pedal is pressed.

The interface, starting from the input signals, produces control signals for the exciting devices 116, 116' and for amplifiers 130 of the exciting devices. For an instrument having 12 strings, 12 exciting devices 116' and 12 amplifiers are used. The amplifiers 130 may either be considered as parts of the exciting devices 116' or as parts of the interface 113. The signals which reach the interface via the MIDI input 125 may comprise various information, the interface 113 including various elements for converting this information. For providing control signals for mechanical deadening 131, a first deadening controller 132 is provided to which signals from the deadening input 129 and from the MIDI input 125 may be supplied. For controlling contact-less deadening, a second deadening controller 133 is provided which processes signals from the position measuring device 124, from the deadening input 129 and from the MIDI input 125 and enables supplying the amplifiers 130 with control signals.

Since the signals which are used via the microphone or sound inputs 127, 126 for controlling the instrument will not be focused to the characteristics of the instrument, the sound quality may be enabled by two different exciting modes using a first and a second filter 134 or 135. A first exciting mode, called resonance mode, uses a common exciting signal of the first filter 134 for simultaneously controlling all amplifiers 130, where the strings 102, in correspondence with their natural frequency and overtone spectra, will response only to signal portions corresponding to the natural frequency of the respective string 102. A second exciting mode, called tone apportion mode, assigns the tones of one signal to those strings 102 on which these tones will sound. Correspondingly, signal portions, starting from the second filter 135, are fed via a tone apportion element 136 to the respective amplifiers 130. If the initial signal stems from the microphone input, it will be changed before the second filter 135, preferably processed by a tone analysis element 137, and in particular the signals for the deadening controllers 132, 133 will be derived from this signal and supplied to them. Furthermore, connections are provided which permit influencing and controlling the filters 134, 135 and the tone apportion element 136 by the MIDI input. The signals of the chromatic input 128 are substantially directly supplied to the corresponding amplifiers.

Figure 10:
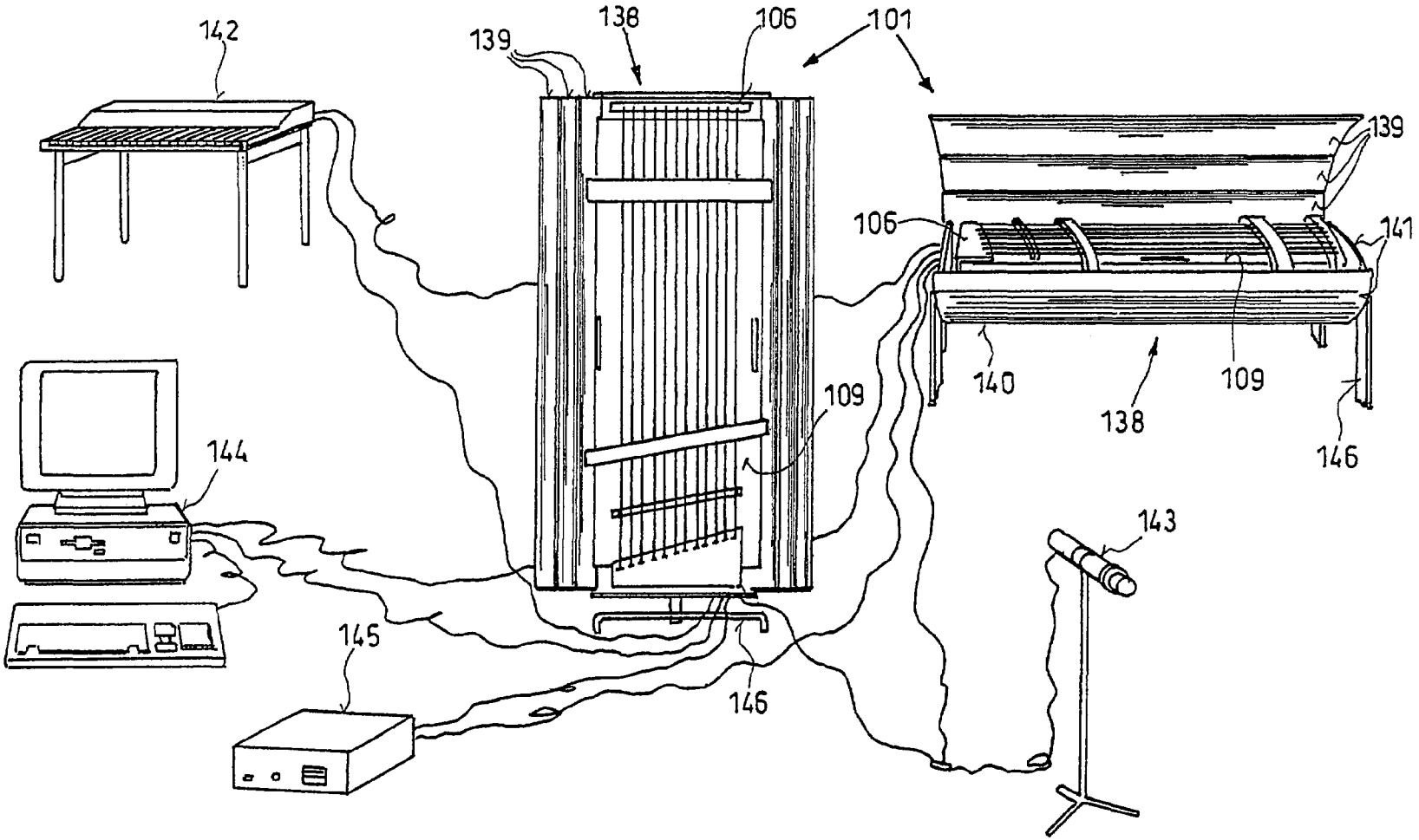
FIG. 10 a perspective representation of a of application possibilities of the instrument.

FIG. 10 illustrates the various application possibilities of an instrument 101 according to the invention that may be used in an upright position or, optionally, in a horizontal position. In each case, the instrument stands on feet 146. To protect the instrument 101 and/or to influence the sound radiation, preferably an envelope 138 is provided. The envelope 138 is connected to the holding device 106 and comprises at least three two-dimensional, preferably curved, lamellar directional elements 139 that may be used for limiting the portion of space into which the sound from the body 109 is radiated off. To enable the envelope 138 to have a protective function, it comprises a bottom portion 140 at the rear of the sounding body averted from the strings, and an adjacent wall portion 141 surrounding the body. The directional elements 139 can engage the wall portion 141 as a lid so that the envelope 138 surrounds the sounding body 109 completely. The directional elements 139 are guided by a guiding device (not shown) having hinges for a radial movement and parallelograms for a proportional longitudinal displacement. The directional elements may, for example, form deviating surfaces which, for example with a horizontally oriented sounding body, extend under an angle of substantially 45° to a horizontal plane above the body, as to deviate the sound of the body, which dominantly exits vertically in upward direction, into a substantially horizontal direction.

For playing the instrument and for providing control signals for the instrument, appliances, such as a keyboard 142, a microphone 143, a synthesizer having a keyboard 144 or any audio-terminal 145 having a signal output, for example a loudspeaker output, may be used. The instrument may be played like a keyboard instrument. However, it may also be possible to use a microphone recording of a customary instrument for controlling purposes. If the instrument receives the signals of an audio-terminal or of a sequencer, it may be used as an automatic home instrument.

Figure 11:
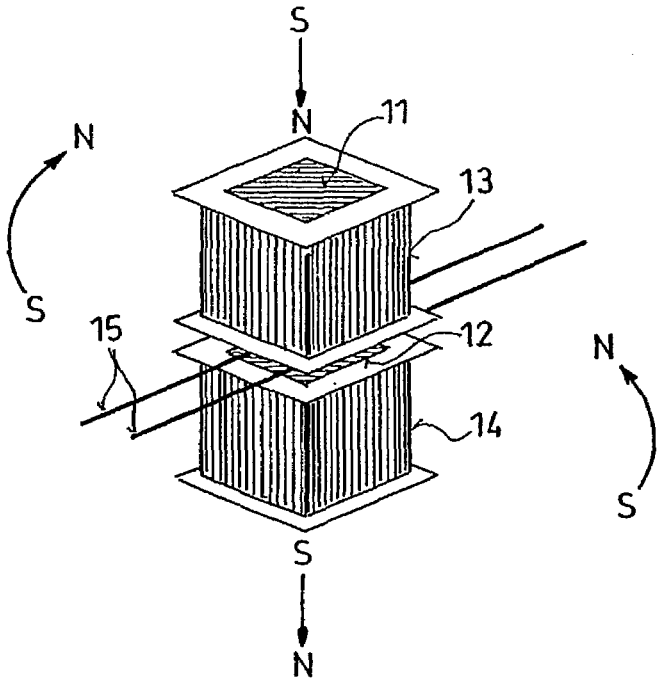
FIGS. 11 12, 13, 14 schematic illustrations of contact-less exciting devices.

With a string instrument according to the invention, strings may be started oscillating by various contact-less exciting devices. FIG. 11 shows an electromagnetic exciting device comprising two hard magnets 11 and 12 that are spaced from one another by some millimeters and are surrounded each by an electromagnet 13 and 14. Through the space between the magnets 11 and 12, a set of one or more strings 15 is drawn. The two hard magnets 11, 12 have to be arranged so that north pole points to south pole. The winding direction of the electromagnets 13, 14, in contrast, has to run one against the other (e.g. north pole to north pole).

Figure 12:
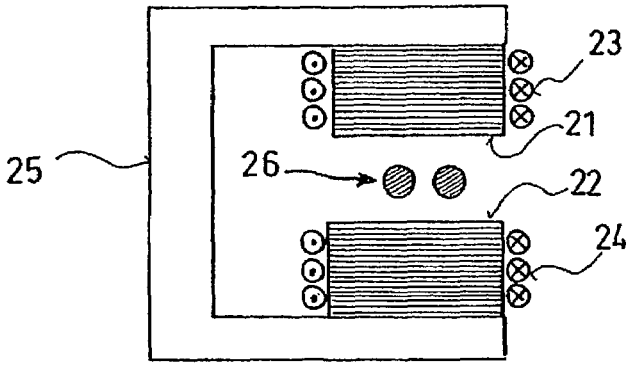

FIG. 12 shows en exciting device having two soft magnets 21 and 22 that are spaced from one another by some millimeters and are surrounded each by an electromagnet 23 and 24. Through the space between the magnets 21 and 22, a set of one or more strings 26 is drawn. The string 26 is traversed by a constant current. The current has to be chosen so that no thermal effects come to fruition within the string.

The current provokes a magnetic field around the string 26. The magnetic fields of the electromagnets 23, 24 and the magnetic field of the string will result in a force acting on the string 26 which causes oscillation.

Figure 13:
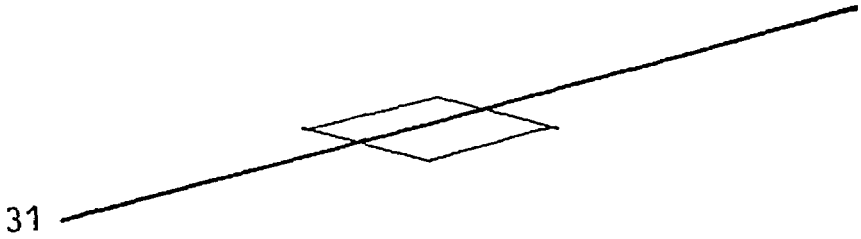

FIG. 13 illustrates an exciting device which achieves a force effect by a modulated electrostatic field and by means of a plate arranged along the string. In addition, a modulating voltage is fed either to the string or to the plate.

Figure 14:
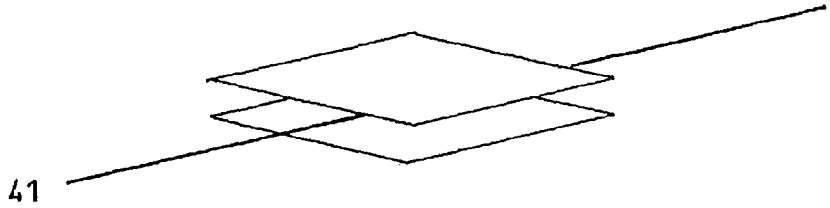

FIG. 14 shows an exciting device comprising a two-plates arrangement which achieves a force effect by a modulated electrostatic field and by two plates (+U=/+1000V and −U=/this way one can make music in all 12 keys; on the 2. partial tone of a string, the first octave may be developed, on the fourth partial tone the double-octave and so forth.

The string instrument according to the invention may consist of an individual instrument or of a plurality of register instruments. An individual instrument needs a set of strings of two chromatic octaves (alto octave, e.g. g to f sharp', and bass octave, counter G to F sharp) to attain a gamut according to standards (in addition to the $2^{nd}$, fourth etc. partial tones). A register instrument has to have a set of strings of a chromatic octave (12 strings). Two register instruments (alto and bass) will also attain a gamut according to standards, like-wise in addition to the $2^{nd}$, fourth etc. partial tones. A quartet of four or a quintet of five register instruments (soprano, alto, tenor, bass and contra-bass) may be played to a higher degree in ground tones by splitting the gamut.

Figure 15A:
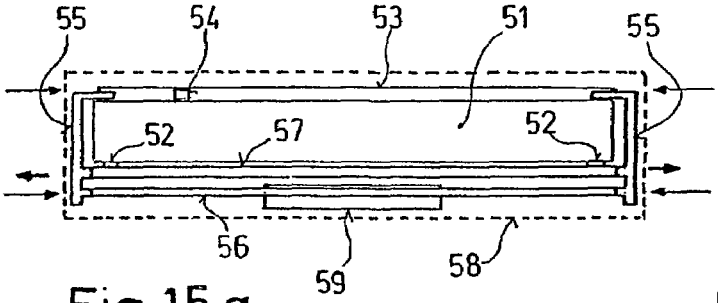
FIG. 15*a* a lateral view of the instrument.
Figure 15B:
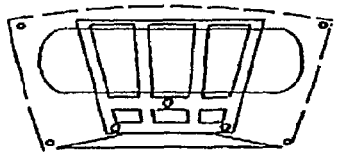
FIGS. 15*b*, 15*c*, 15*d* schematic front views of the instrument.

The design of the register instrument according to the invention (FIG. 15*a*) separates the sounding parts, the static parts and the protective parts. Above a sounding body 51 held by transfer parts 52 of an outer construction, the strings 53 are pre-stressed over a bridge 54. The stress of the strings is held by an enveloping frame comprising two lateral portions 55 which are born by a central support column 57 and biased by a counter-force by means of two back pull elements 56. The envelope 58 is used both as a protection and as a bell mouth or may be separated from the actual instrument (sounding body and enveloping frame).

Figure 15C:
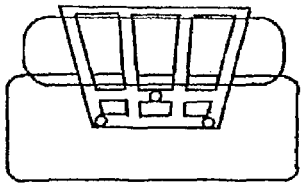
Figure 15D:
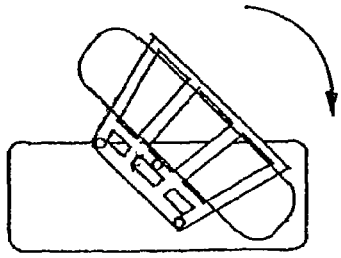

The design of the register instrument according to the invention enables playing in a horizontal position (lying flat as a piano) as well as in a vertical position (upright like the register of a church organ). The instrument can be turned in either position about its main axis (FIGS. 15*c*, 15*d*). This is very convenient in a horizontal position in order to render the radiation angle either to the playing person or to the audience selectable.

The protective envelope according to the invention (FIG. 16*a*, a horizontal cross-section of the upright instrument) consists of a back element R and of two movable wings F1 and F2. The two wings are provided with hinges at the rear Sh and in the middle Sm and are, thus, movable. By a number of lamellae, which may be shifted one above the other, the wings F1, F2 may be shortened or prolonged (FIG. 16*c*). These lamellae can be pivoted outwards and opened so that a sound radiation is possible through the protective envelope (FIG. 16*b*).

The two wings F1 and F2 of the register instrument according to the invention can be arranged and modified as follows:

Instrument upright: closed condition (FIG. 16*a*; horizontal cross-section)

Instrument upright: Lamellae pivoted outwards, opened (FIG. 16*b*; horizontal cross-section).

Instrument upright: both wings are opened as a bell mouth towards a concert hall (FIG. 16*c*; horizontal cross-section).

Instrument lying flat: the first wing F1 is disassembled into parts H and V, and is laterally mounted (as a casing), while the whole second wing F2 is used as a lid and bell mouth H and V, and the middle hinge is arrested (FIG. 16*d*).

I claim:

1. An instrument having at least one tunable string, a holding device for holding the at least one string and for prestressing said at least one string with a tensioning force of at least 200N, at least one electrically operated exciting device for contactiessly exciting of said at least one string, a sounding body for acoustically radiating oscillations of the string, a bridge rendering transferable said oscillations of the string to said sounding body, and an interface for supplying a signal for controlling said at least one exciting device.

2. The Instrument of claim 1 wherein said holding device comprises two lateral parts and at least one supporting column connected to said two lateral parts, the at least one string being attached to both lateral parts and being tensionable for tuning purposes.

3. The Instrument of claim 2 wherein said body is arranged between said strings and said at least one supporting column.

4. The instrument of claim 3 wherein a spacing adjustment device is inserted between said body and said holding device, said adjustment device enables said body together with said bridge to be pressed against said at least one string.

5. The Instrument of claim 2 wherein said body comprises a membrane, a casement closed in the shape of a ring and, in particular, a bottom, wherein on one of the front surface of the casement the membrane is attached, while on the other front surface said bottom is arranged, and the membrane is facing said at least one string.

6. The Instrument of claim 2 wherein at least one opening is formed in said body by which an air exchange is enabled from the interior of the body to ambient, said at least one opening being formed within the region of at least one part of the casement.

7. The Instrument of claim 2 wherein a set of strings is chromatically tuned.

8. The instrument of claim 7 wherein said chromatically tuned set of strings comprising at least 12 strings extending over one octave.

9. The Instrument of claim 2 wherein a deadening device is provided.

10. The instrument of claim 9 wherein said deadening device enables detecting the actual oscillations by means of a sensor for achieving selective deadening, and enables feeding said string with an exciting signal.

11. The instrument of claim 9 wherein said deadening device is a mechanical deadening device which enables pressing electro-mechanically actuated damping elements against said string.

12. The Instrument of claim 2 wherein said instrument may be positioned both horizontally and vertically.

13. An Instrument having at least one tunable string, a holding device for holding the at least one string, at least one electrically operated exciting device for contactlessly exciting of said at least one string, a sounding body for acoustically radiating oscillations of the string, a bridge rendering transferable said oscillations of the string to said sounding body, and an interface for supplying a signal for controlling said at least one exciting device, wherein said at least one string comprises a magnetizable material and said at least one exciting device comprises two coils situated at both sides of an air gap including said string and substantially wound around a common coil axis which is oriented transversely to the string, and a magnetic device for generating a permanent magnetic field said permanent magnetic field in the region of said air gap extending substantially parallel to said coil axis, and said coils being wound and connected in such a manner that they generate magnetic fields of equal poles opposite to each other when traversed by a current, so that a non-homogeneous magnetic field can be generated in said air gap which enables said string to be biased by a deflection force.

14. The Instrument of claim 13, wherein said magnetic device for generating a permanent magnetic field comprising at least one permanent magnet of high magnetic flux density, and at least one of magnetizable material is provided which, together with said at least one inserted permanent magnet form a substantially closed magnetic field conductor with exception of said air gap.

15. The instrument of claim 14 wherein said at least one permanent magnet of high magnetic flux density is one out of the group of samarium-cobalt (SmCo) and neodymium-iron-boron (NdFeB) magnets.

16. The instrument of claim 14 wherein said magnetic device including two E-shaped core parts which are interconnected at the two outer projections each through a permanent magnet, while around each of the center projections one of said two coils is arranged.

17. The Instrument of claim 13 wherein said interface comprises at least one MIDI input, said interface comprising further signal processing elements which, starting from the input signals, enable obtaining control signals for amplifiers of the exciting devices.

18. The instrument of claim 17 wherein said interface comprises a plurality of sound inputs which are switchable from analogue to digital and vice-versa, said sound inputs being out of the group of microphone input, chromatic input and deadening input and said further signal processing elements being out of the group of filters, analysis elements and apportion elements.

19. A process for generating sound, comprising the steps of receiving an external signal for feeding to at least one amplifier, feeding said external signal to at least one amplifier, pre-stressing a string with a tensioning force of at least 200N, contactlessly exciting a pre-stressed string by an exciting device operated electrically by said amplifier, transferring the string's oscillation to a sounding body via a bridge, and acoustical radiating the oscillations transferred to said sounding body.

20. The Process of claim 19 wherein for contact-less exciting the string, the string comprises a magnetizable material and two coils situated at both sides of an air gap including said string, wound in opposite direction around a common coil axis, which is oriented transversely to the string and, simultaneously fed by said amplifier, said process further comprising the step of generating a permanent magnetic field which is in the region of said air gap extending substantially parallel to said coil axis, and said coils generating alternating non-homogeneities within the permanent magnetic field in the region of said air gap.

21. The Process of claim 19 wherein a chromatically tuned set of strings comprising at least 12 strings as well as an exciting device for each string is provided, while the sound quality is optimized by using filters and two different methods of excitement, a first exciting method, called resonance mode, supplying a common exciting signal for simultaneously controlling all exciting devices, while a second exciting method, called tone apportion mode, supplies a special exciting signal to each exciting device in correspondence with the tuning of the string thus to be excited.

* * * * *